United States Patent [19]
Zacky
[11] 4,281,883
[45] Aug. 4, 1981

[54] PANEL MOLDING SUPPORT STRUCTURE

[76] Inventor: Ralf G. Zacky, 4491 Deanwood Dr., Woodland Hills, Calif. 91364

[21] Appl. No.: 95,416

[22] Filed: Nov. 19, 1979

[51] Int. Cl.[3] ..... A47F 3/00; F16B 12/00
[52] U.S. Cl. ..... 312/140; 312/257 R; 312/263; 312/324; 52/282
[58] Field of Search ..... 312/140, 257 R, 263 SR, 312/264, 324; 403/172, 176; 52/126, 280, 282

[56] References Cited

U.S. PATENT DOCUMENTS

| | | | |
|---|---|---|---|
| 3,316,041 | 4/1967 | Nelson | 312/140 |
| 3,365,257 | 1/1968 | Diack | 312/140 |
| 3,877,765 | 4/1975 | Hassing | 312/140 |
| 4,126,364 | 11/1978 | Reilly | 312/263 |
| 4,157,852 | 6/1979 | Zacky | 312/263 |

*Primary Examiner*—Casmir A. Nunberg
*Attorney, Agent, or Firm*—Charles H. Schwartz; Ellsworth R. Roston

[57] ABSTRACT

A panel molding support structure for use with a display case, including an outer frame located within a particular plane including at least four tubular members, each having substantially the same cross-section and interconnected at end portions by joints to form the outer frame and with the four tubular members located within the particular plane and with the tubular members having a square cross-section and turned angularly to have an angular orientation, an inner frame located within the particular plane including at least four moldings extending along and complementary to the tubular members to form the inner frame and with the inner frame located within the outer frame and within the particular plane, the moldings each including an angular outer surface extending along the length of the molding and with the angular outer surface matching the angular orientation of the tubular members to have the moldings forming the inner frame matching and conforming to the outer angular configuration of the outer frame, and the moldings each including a channel extending along the length of the molding and with the channels receiving and supporting a panel member within the inner frame and within the particular plane.

20 Claims, 9 Drawing Figures

PANEL MOLDING SUPPORT STRUCTURE

The present invention is directed to an improved panel molding support structure for use as part of a display case. The display case itself is formed using a unique molding structure in association with existing shelf and display systems.

Reference is made to U.S. Pat. No. 4,157,852 issued June 12, 1979, listing Ralph G. Zacky as inventor. This patent is directed to a unique structure for a display case or other panel support systems. The issued patent discloses the use of a molding used in association with an existing shelf and display system. As an example, the molding may be used with a shelf and display system generally referred to as the "Reflected System." The Reflected System uses square tubing oriented to present an angular presentation to the viewer of the system.

In the issued patent it is disclosed that the particular type of existing shelf and display system such as the reflected system may be used to construct a box-like structure, and with each side of the box having outer frames formed by the tubular members. Auxiliary moldings fit within the outer reflected tubing frames on a number of the sides of the reflected structure. Specifically, each molding includes a groove extending along the molding on the top of the molding and with the groove designed to accept an angular portion of each tubular member. Four such moldings are used for the particular sides of the display case, and thereby form an inner frame located and locked within the outer frame.

In the issued U.S. Pat. No. 4,157,852, the moldings are used to form inner frames for all sides of the display case so as to support either glass or solid panels. In the issued patent a specific structure for supporting sliding panels or doors is shown, so as to provide for a completely enclosed display case. In co-pending patent application Ser. No. 93,159, filed Nov. 13, 1979, now U.S. Pat. No. 4,274,688, an improved sliding door structure is shown for use with larger size display cases so as to support larger sliding panel doors.

The present invention is directed to a panel molding support structure for supporting panels such as glass to provide for a hinged door structure as opposed to a sliding door structure. Alternatively, a similar panel molding support structure of the present invention may be used to support a panel such as a piece of glass for a top wall of a display case and provide for a flush surface for the top of the display case.

The panel molding support structure of the present invention includes an angular outer surface to match an angularly presented wall portion formed by the angular orientation of the tubular members providing the outer frame. This angular outer surface of the molding may be hinged to the tubular member when the molding is used to support a door structure, or may be attached using appropriate means such as adhesive when the molding is used to support a wall panel such as a top wall. The molding also includes a channel portion having surface thereof which forms a 45° angle relative to the angular outer surface so that the molding may receive and support a panel member such as glass.

For example, if the molding is used to support a top wall, the channel may have an L-shaped configuration so that the panel member such as glass may be dropped into the channel in the molding after the molding is positioned within the outer tubular members forming an inner frame. If, however, the molding is used to provide for a hinged door structure then the moldings may be interlocked to form the inner frame and with the channel having a U-shaped configuration so as to receive and support the panel such as glass.

When the molding is used to provide for a door structure, the molding may include a second channel which is formed along the angular outer surface and with this second channel used to receive corner locking members so as to lock the molding members together to form the door structure. The corner locking members may be formed from a flat piece of metal which has two arms angularly arranged and with the flat piece bent so that the two arms form a right angle structure and with the arms each slid into the second channel of two adjacent molding members to provide for interlocking adjacent molding members at right angles to each other. The channels may also be used to receive locking pieces which may be used to lock a hinge member to the angular outer surface of the molding forming one edge of the door structure.

A clearer understanding of the present invention will be had with reference to the following description and drawings wherein.

As indicated above, the present invention provides for an improved panel molding support structure for use with a display case formed by a panel support system as shown in U.S. Pat. No. 4,157,852 issued June 12, 1979, and listing Ralph G. Zacky as the inventor. Reference is specifically made to this patent, and the subject matter of this patent is incorporated herein so as to provide for a fuller disclosure of the present invention.

Figures 1, 2, 6, 7, 9:
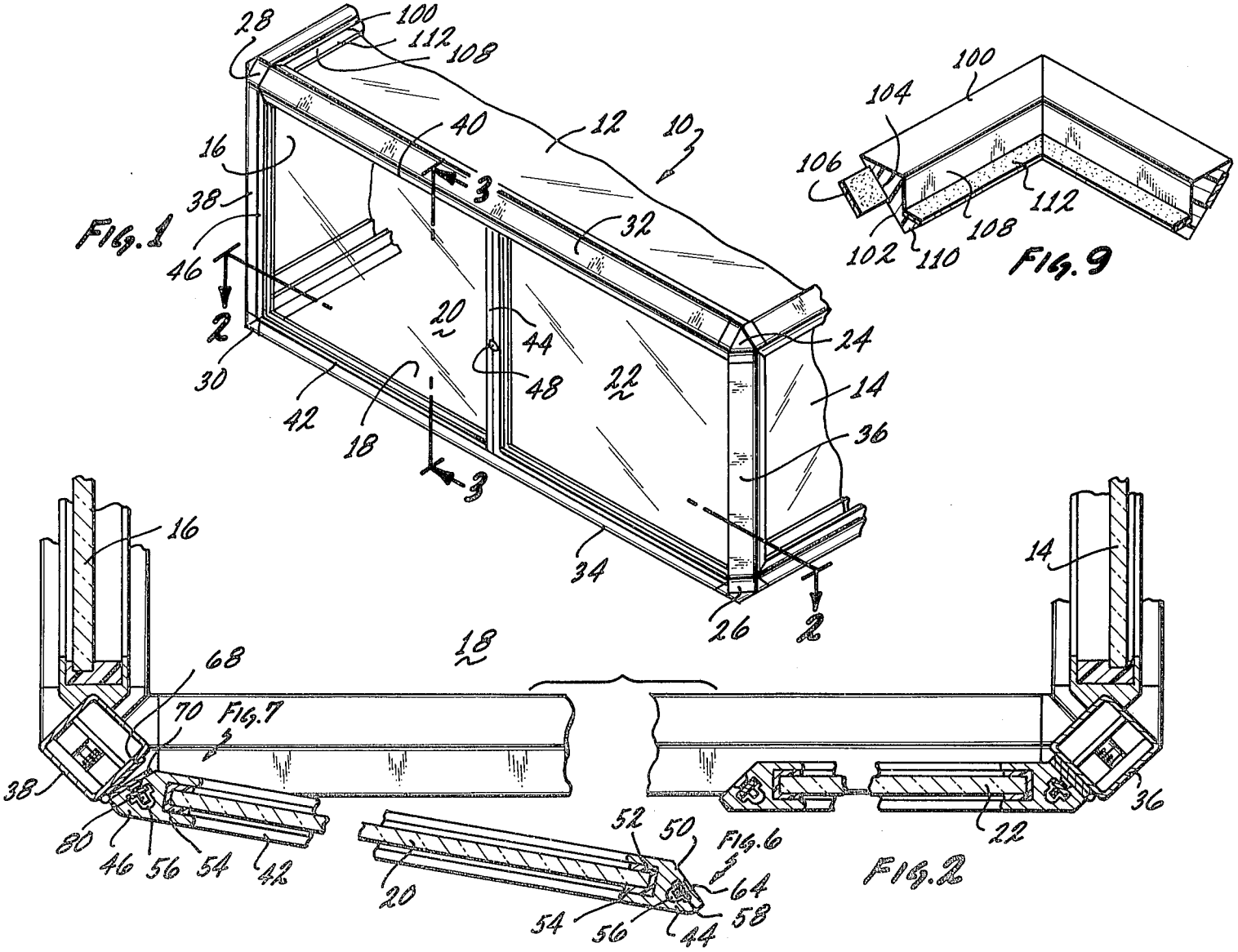
FIG. 1 illustrates a perspective view of a portion of a display case using moldings for receiving and supporting a pair of hinged glass doors and a top wall panel.
FIG. 2 illustrates a cross-sectional view of the portion of the display case taken along lines 2—2 of FIG. 1.
FIG. 6 illustrates a cross-sectional detail of a molding member taken along lines 6—6 of FIG. 5.
FIG. 7 illustrates a detail of a molding member attached to the tubular member with a hinge.
FIG. 9 illustrates a perspective view of a molding member used to support a top wall portion of the display case.
Figures 3, 4, 5, 6, 7, 8:
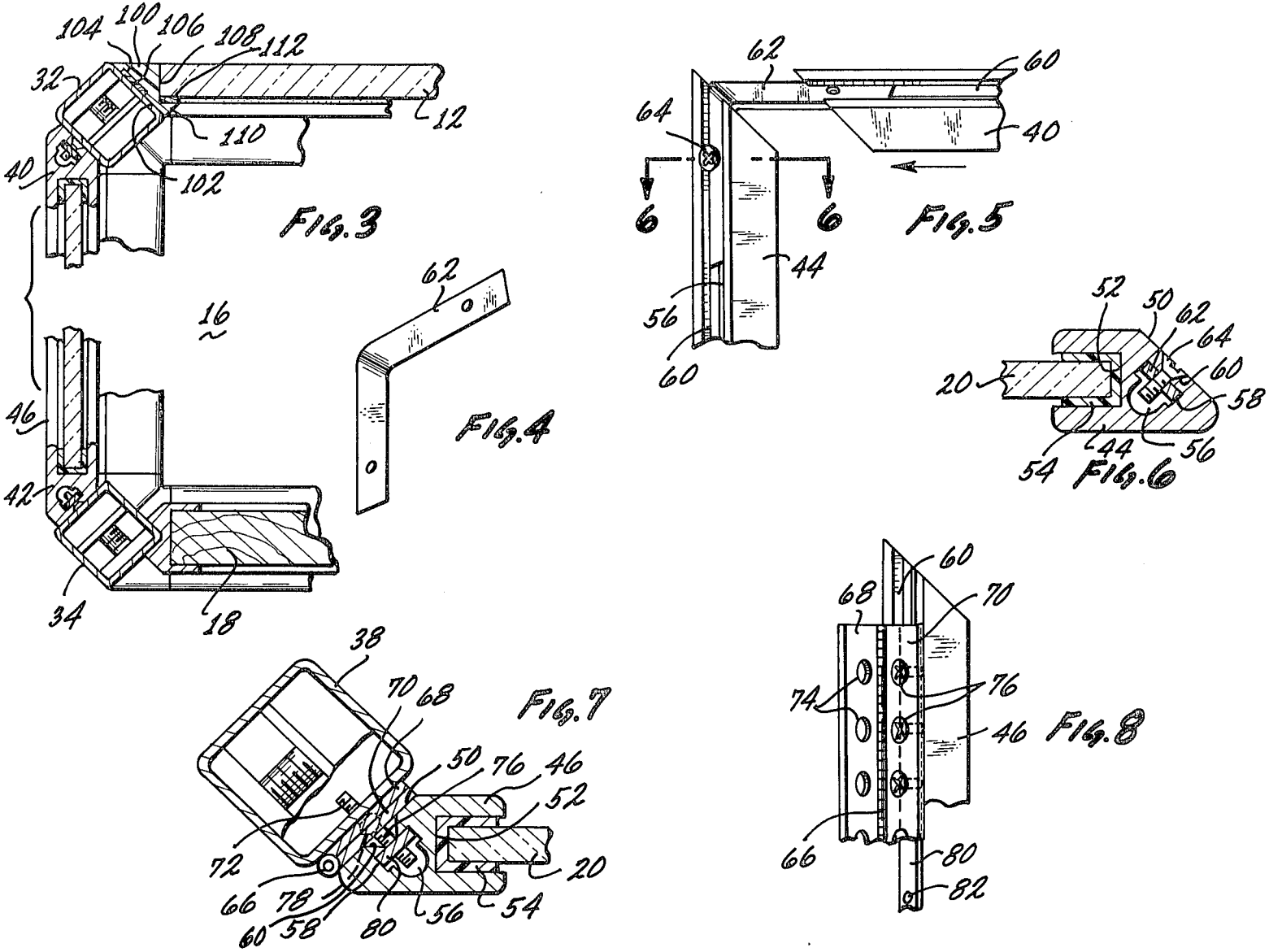
FIG. 3 illustrates a cross-sectional view of the portion of the display case taken along lines 3—3 of FIG. 1.
FIG. 4 illustrates a flat locking member used to interlock adjacent molding members for forming a hinged door structure.
FIG. 5 illustrates the locking means of FIG. 4, bent to a right angle configuration and interlocking two adjacent molding members.
FIG. 8 illustrates a detail of the hinge attached to a molding member.

In FIG. 1 a display case 10 includes a top wall 12, side walls 14 and 16, a bottom wall 18, and a front wall (not shown). FIGS. 2 and 3 also illustrate the different wall members. The display case also includes a back wall formed by two hinged doors, including glass panels 20 and 22.

The outer frame of the display case 10 is formed from an existing shelf and support system commonly referred to as the Reflected System. This system includes joint members 24, 26, 28 and 30 which interconnect four outer tubular members 32, 34, 36 and 38. Tubular members 32 and 34 form top and bottom outer frame members, while tubular members 38 and 40 form the side outer frame members. The four tubular members together form the outer frame to receive and support the hinged door structure. Similar outer frames are formed using additional joint members and tubular members so as to support the other wall portions of the display case 10.

Each hinged door structure includes four molding members, and since the left and right hand door structures are substantially identical although reversed, only the door structure for glass panel 20 will be described. Specifically, molding members 40 and 42 form the top and bottom inner frame members while molding members 44 and 46 form the side inner frame members. It is to be appreciated that although the specific embodiment shown in this application includes a pair of side-by-side hinged doors, the back wall may also be formed by a single hinged door. The particular molding members used to provide for the door structure are identical and either single or double doors may be constructed and with the inner surface of the moldings matching the outer surface of the tubular members forming the outer frame. One of the hinged doors may include a lock so as to interlock the doors to prevent the doors from being opened. As an example, a lock 48 is shown to interlock the doors.

FIGS. 4, 5 and 6 illustrate in more detail the construction of a first embodiment of the molding for providing for the hinged doors, and also the structural arrangement for interconnecting adjacent moldings to form an inner frame. As seen in FIG. 6, molding 44, which is identical in configuration to all of the other moldings used to make the hinged door, includes an angular outer surface 50. The molding also includes a U-shaped channel 52 to receive and support the panel such as the glass panel 20. The bottom surface of the channel 52 is at a 45° angle to the angular wall surface 50. The channel 52 may include a plastic extrusion 54 so as to securely receive the panel 20 and to cushion the edge portions of the panel.

Extending inward from the surface 50 is a second channel 56. The channel 56 includes an enlarged section 58. The channel 56 is also formed with a V-shaped portion 60 leading into the interior of the channel 56. As shown in FIG. 5, a locking member 62, bent to provide for a right angle configuration between its arms, provides for locking together adjacent moldings 40 and 44, each having a mitered corner. The arms of the locking member 62 slide into the enlarged portion 58 of the channel 56, as shown in FIG. 6. A screw member 64 passes through the V-shaped portion 60 to engage an opening in the locking member 62. The V-shaped portion 60 matches the V-shape of the head of the screw 64, so that when the screw is tightened down to lock the arm of the locking member 62 in position, the head of the screw 64 is flush with the angular outer surface 50.

The locking member 62 is shown prior to bending in FIG. 4, and it can be seen that this member may be stamped out of flat stock and have the arms forming an obtuse angle. The arms of the locking member 62 are then bent to have a 90° relationship as shown in FIG. 5, but the arms are no longer in the same flat plane after they are bent to the right angle configuration shown in FIG. 5. After bending each arm is in a plane parallel to the angular outer surface 50 so as to lock adjacent molding members together.

FIGS. 7 and 8 illustrate the hinged connection between the molding member 46 and the tubular member 38. The molding 46 is substantially identical to the molding 44 shown in FIG. 6, and includes the same second channel 56 with the enlarged portion 58. In addition, the molding 46 also includes the first U-shaped channel 52 to receive the plastic extrusion 54 to support the glass panel 20. The molding 46 also includes the angular outer surface 50 which is at a 45° angle to the bottom surface of the channel 52. The angular configuration of the angular outer surface 50 is such as to match the angular orientation of the tubular member 38. All of the other molding members which form the inner frame for the hinged doors have the same angular outer surface configuration and thereby also match the angular orientation of the various tubular members forming the outer frame.

The molding 46 and thereby the entire door structure is hinged to the tubular member 38 using a hinge 66. The hinge 66 includes two leaves 68 and 70. The leaf 68 is attached to the tubular member through the use of screws 72, which screws pass through openings 74 in the hinge leaf, and with the openings 74 having a V-shaped configuration to receive the V-shaped head of the screws 72. Similarly, the leaf 70 is attached to the molding 46 through the use of screws 76, which screws pass through V-shaped openings 78 in the leaf 70. The actual attachment of the hinge to the molding 46 is accomplished through the use of a flat locking piece 80 which is positioned within the enlarged section 58 of the recess 56. This flat locking piece 80 includes openings 82 to receive the screws 76, and the flat locking piece is slid into the enlarged section 58. When the screws 76 are tightened this locks the locking piece 80 within the enlarged section 58 to thereby lock the hinge 70 to the molding 46. The locking piece 80 may either be a single elongated member or may be a plurality of short members. Also the locking member 62 may include additional openings to receive screws to also aid in locking the hinge member to the molding 46.

FIG. 9 illustrates a second embodiment of a panel molding support structure for use in supporting a top panel for providing for a flush top surface for the display case 10. FIG. 3 also illustrates in cross-sectional view the use of this second embodiment of the molding. Specifically, a molding 100 includes an angular outer surface 102, which angular outer surface matches the angular orientation of the tubular member 32. The angular outer surface 102 includes a channel 104 which receives a two-sided adhesive member 106. The adhesive member 106 attaches the molding 100 along its length to the tubular member 32. The molding 100 also includes an L-shaped channel 108 which is open on one side and has a shelf portion 110. The shelf portion 110 is used to support an edge portion of the glass panel 12. A two-sided adhesive member 112 may be interposed between the shelf portion 110 and the panel 12 so as to attach the panel 12 in position.

It can be seen from FIGS. 3 and 9 that the glass panel 12 is cut in a normal manner to have its edges at right angles to its flat surfaces. This structure provides for the maximum protection against chipping of the edge of the glass. Prior to the use of the molding 100, the edge of the glass panel was itself beveled to match the angular orientation of the tubular member 32. Providing such a beveled edge was expensive, and also this beveled edge tended to chip, thereby necessitating frequent replacement of the top wall of the display case. The use of the molding 100 along all four sides of the outer frame to thereby form an inner frame eliminates the use of glass having a beveled edge and significantly reduces the cost of the glass and reduces chipping of the edge. The use of the molding 100 also facilitates replacement of the glass, since the glass is merely dropped into the inner frame and is securely held in position to provide for a substantially flush surface for the top wall of the display case.

The present invention, therefore, provides for a panel molding support structure which may be used in one embodiment to provide for a hinged door structure produced by an inner frame which has a configuration to match the angular orientation of the outer frame. In addition, a second embodiment of the molding similarly forms an inner frame having a configuration to match the angular orientation of the outer tubular member and to support a panel such as a glass panel to provide for a flush top surface for the display case.

Although the invention has been described with reference to particular embodiments, it is to be appreciated that various adaptations and modifications may be made and the invention is only to be limited by the appended claims.

I claim:

1. A panel molding support structure for use with a display case, including an outer frame located within a particular plane including at least four tubular members, each having substantially the same cross-section and interconnected at end portions by joints to form the outer frame and with the four tubular members located within the particular plane and with the tubular members having a square cross-section and turned angularly to have an angular orientation and with each of the four tubular members including an angular outer surface located adjacent to each other and forming an inner frame surface to receive an inner frame, an inner frame located within the particular plane including at least four moldings each extending along and complementary only to the angular outer surface of each of the tubular members to form the inner frame and with the inner frame located within inner frame surface of the outer frame and within the particular plane, the moldings each including only a single angular inner surface extending along the length of the molding and with the angular inner surfaces matching the angular orientation of the inner frame surface of the tubular members to have the moldings forming the inner frame matching and conforming only to the inner frame surface of the outer frame, and the moldings each including a channel extending along the length of the molding and with the channels receiving and supporting a panel member within the inner frame and within the particular plane.

2. The panel molding support structure of claim 1 wherein the moldings forming the inner frame forms a door structure and additionally including a hinge member having leaves and with one leaf attached along one side molding against the angular inner surface and the other leaf attached along the angular outer surface of the corresponding tubular member to provide for the door being opened around the hinge member.

3. The panel molding support structure of claim 2 additionally including two inner frames located side by side within the outer frame to form two doors hinged from the opposite side tubular members.

4. The panel molding support structure of claim 2 wherein the channel has a U-shaped configuration and additionally including a U-shaped plastic extrusion positioned within each channel and with the plastic extrusion receiving and supporting the panel member.

5. The panel molding support structure of claim 2 wherein the moldings include a second channel extending along the molding and along the angular inner surface and with the second channel including an enlarged portion and additionally including a locking member having a pair of arms at right angles to each other and with the arms positioned within the enlarged portions of adjacent moldings to interlock adjacent moldings.

6. The panel molding support structure of claim 5 wherein the locking member is formed from flat material and with the arm members in the flat initially at an obtuse angle to each other and with the arm members when bent to form the 90° angle having the arm members in planes parallel to the angular inner surfaces of the moldings.

7. The panel molding support structure of claim 5 additionally including locking pieces located within the enlarged portion of the channel and with the one leaf of the hinge member attached to the molding using the locking pieces.

8. The panel molding support structure of claim 1 wherein the channel has an L-shaped configuration and with the moldings receiving panel members having substantially the same height as the height of the L-shaped channel to form a substantially flush surface between the outer frame, the inner frame and the panel.

9. The panel molding support structure of claim 8 wherein the moldings include a second channel on the angular inner surface and additionally including adhesive material in the second channel to adhere the moldings to corresponding outer surfaces of the tubular members.

10. The panel molding support structure of claim 8 additionally including adhesive material in the L-shaped channel to adhere the panel member within the L-shaped channel.

11. A plurality of moldings for forming an inner frame for supporting panels in combination with a shelf and display system of the type wherein an outer frame is formed in a particular plane of at least four tubular members each having substantially the same square cross-section and each interconnected at end portions by joints and turned angularly to have an angular orientation and with each of the four tubular members including an angular outer surface located adjacent to each other and forming an inner frame surface to receive the inner frame and with the moldings each having substantially the same cross-sections and including an angular inner surface extending along the length of each molding with the angular inner surface matching only the angular orientation of the angular outer surface of the tubular member to provide for the molding only lying flush with the angular outer surface of the tubular member and within the particular plane, a channel extending along the length of each molding for receiving edge portions of the panel for supporting the panel within the particular plane, and four moldings forming an inner frame within the particular plane and only extending within and complementary to the inner frame surface of the tubular members forming the outer frame.

12. The moldings of claim 11 wherein the moldings forming the inner frame forms a door structure and additionally including a hinge member having leaves and with one leaf attached along one side molding against the angular inner surface and the other leaf attached along the angular outer surface of the corresponding tubular member to provide for the door being opened around the hinge member.

13. The moldings of claim 12 additionally including two inner frames located side by side within the outer frame to form two doors hinged from the opposite side tubular members.

14. The moldings of claim 12 wherein the channel has a U-shaped configuration and additionally including a U-shaped plastic extrusion positioned within each channel and with the plastic extrusion receiving and supporting the panel member.

15. The moldings of claim 12 wherein the moldings include a second channel extending along the molding and along the angular inner surface and with the second channel including an enlarged portion and additionally including a locking member having a pair of arms at right angles to each other and with the arms positioned within the enlarged portions of adjacent moldings to interlock adjacent moldings.

16. The moldings of claim 15 wherein the locking member is formed from flat material and with the arm members in the flat initially at an obtuse angle to each other and with the arm members when bent to form the 90° angle having the arm members in planes parallel to the angular inner surfaces of the moldings.

17. The moldings of claim 15 additionally including locking pieces located within the enlarged portion of the channel and with the one leaf of the hinge member attached to the molding using the locking pieces.

18. The moldings of claim 11 wherein the channel has an L-shaped configuration and with the moldings receiving panel members having substantially the same height as the height of the L-shaped channel to form a substantially flush surface between the outer frame, the inner frame and the panel.

19. The moldings of claim 18 wherein the moldings include a second channel on the angular inner surface and additionally including adhesive material in the second channel to adhere the moldings to corresponding angular surfaces of the tubular members.

20. The moldings of claim 18 additionally including adhesive material in the L-shaped channel to adhere the panel member within the L-shaped channel.

* * * * *